US008908479B2

(12) United States Patent
Teng et al.

(10) Patent No.: US 8,908,479 B2
(45) Date of Patent: Dec. 9, 2014

(54) ELECTRONIC WRIST WATCH HAVING WIRELESS CHARGING FUNCTION

(71) Applicant: Hon Hai Precision Industry Co., Ltd., New Taipei (TW)

(72) Inventors: Ju-Wen Teng, New Taipei (TW); Hsi-Hung Fu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 14/060,622

(22) Filed: Oct. 23, 2013

(65) Prior Publication Data

US 2014/0177399 A1 Jun. 26, 2014

(30) Foreign Application Priority Data

Dec. 24, 2012 (TW) ..... 101224976 U

(51) Int. Cl.
*G04B 1/00* (2006.01)
*G04G 19/00* (2006.01)

(52) U.S. Cl.
CPC ..... *G04G 19/00* (2013.01)
USPC ..... 368/204

(58) Field of Classification Search
CPC ..... G04G 19/00; G04G 19/08; G04C 10/00; G04C 3/008; G04C 10/04
USPC ..... 368/203–205, 281–282, 10–11, 47, 22, 368/165, 223
See application file for complete search history.

(56) References Cited

U.S. PATENT DOCUMENTS

| | | | | |
|---|---|---|---|---|
| 5,889,737 | A * | 3/1999 | Alameh et al. | 368/204 |
| 6,158,884 | A * | 12/2000 | Lebby et al. | 368/282 |
| 6,619,835 | B2 * | 9/2003 | Kita | 368/281 |
| 6,874,931 | B2 * | 4/2005 | Noirjean et al. | 368/282 |
| 8,482,909 | B2 * | 7/2013 | Douglas | 361/679.03 |

* cited by examiner

*Primary Examiner* — Edwin A. Leon
(74) *Attorney, Agent, or Firm* — Novak Druce Connolly Bove + Quigg LLP

(57) ABSTRACT

An electronic wrist watch having wireless charging function is provided. The watch includes a body, a watch strap portion, at least one chargeable battery and a wireless charging module. The watch strap portion includes two watch straps respectively connected to opposite ends portions of the body, and used to wear the electronic wrist watch on wrist. The rechargeable battery and the wireless charging module are arranged in the watch-strap portion, and the wireless charging module is electrically connected to the rechargeable battery. The wireless charging module is configured to wirelessly collect external energy to charge the rechargeable battery. With such a configuration of the rechargeable battery and the wireless charging module arranged in the watch-strap portion, capacity of the rechargeable battery can be effectively expanded, and charging process of the rechargeable battery can be effectively simplified, without changing the size of the electronic wrist watch.

8 Claims, 2 Drawing Sheets

ELECTRONIC WRIST WATCH HAVING WIRELESS CHARGING FUNCTION

BACKGROUND

1. Technical Field

The present disclosure relates to watches, and particularly to an electronic wrist watch having wireless charging function.

2. Description of Related Art

With the popularization of small size and powerful electronic devices, electronic wrist watches are not only used to show time, but also integrated with various auxiliary functions, such as audio playing function, near field communication (NFC) identification function, or GPS locating function. However, with addition of these auxiliary functions, power consumption is also increased. Therefore, expanding the capacity of a battery of the electronic wrist watch and simplify the charging process of the battery, without affecting the size of the electronic wrist watch are several of important aspects in manufacturing.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
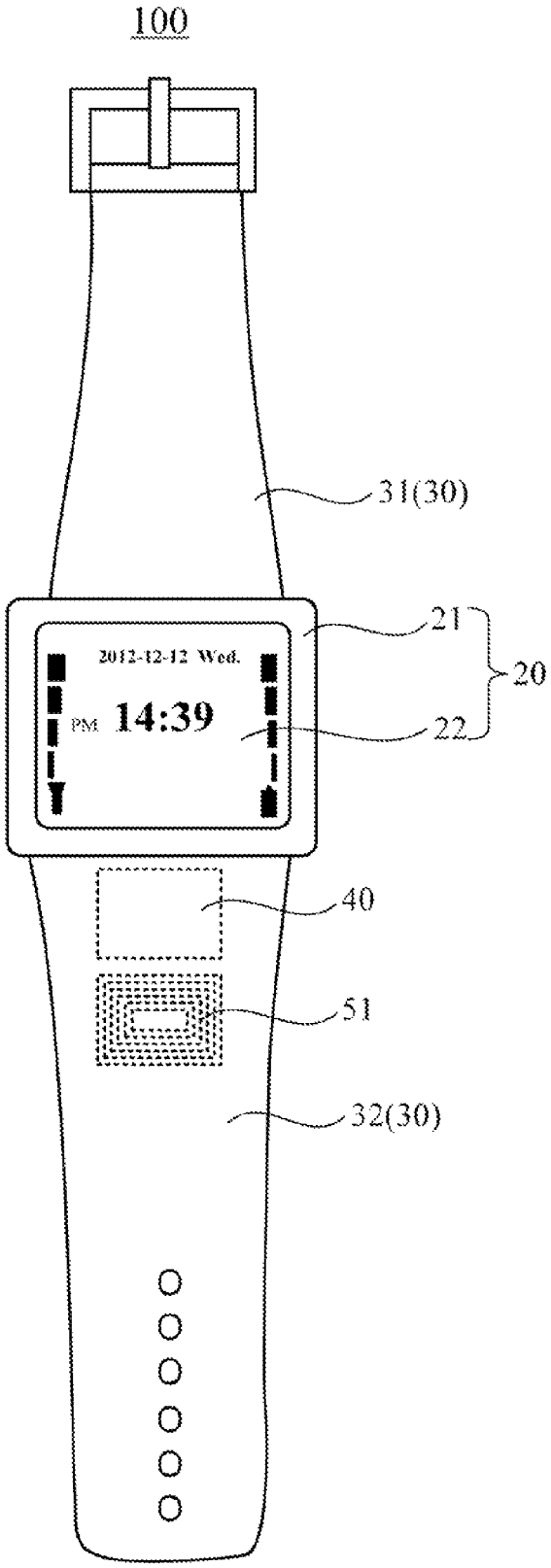
FIG. 1 is a schematic diagram of an electronic wrist watch, according to a first embodiment.

FIG. 1 shows an electronic wrist watch 100 of the embodiment. The electronic wrist watch 100 includes a body 20 and a watch-strap portion 30. The body 20 includes a shell 21 and a display unit 22 arranged on the shell 21. The shell 21 can be made of stainless steel, plastic or other materials.

The watch-strap portion 30 includes a first watch strap 31 and a second watch strap 32 respectively connected to opposite end portions of the body 20. The first watch strap 31 and the second watch strap 32 are used to wear the electronic wrist watch 100 on a wrist.

In the illustrated embodiment, the electronic wrist watch 100 further includes at least one chargeable battery 40, which is configured to supply power to function modules of the electronic wrist watch 100. In the illustrated embodiment, the rechargeable battery 40 is a flexible thin-film battery, and is arranged in the watch-strap portion 30. In other embodiments, the rechargeable battery 40 can be arranged in the shell 21 of the body 20.

In the illustrated embodiment, the electronic wrist watch 100 further includes a wireless charging module 50, which is arranged in the watch-strap portion 30 and is electrically connected to the rechargeable battery 40. The wireless charging module 50 is configured to wirelessly collect external energy to charge the rechargeable battery 40.

In the illustrated embodiment, the wireless charging module 50 includes a receiving coil 51 for collecting wireless electromagnetic energy emitted by a transmitting coil (not shown) of an external power source (not shown). The wireless charging module 50 further includes a conversion module 52 configured to convert the collected wireless electromagnetic energy into power having a predetermined voltage to charge the rechargeable battery 40.

Therefore, with such a configuration of the rechargeable battery 40 and the wireless charging module 50 arranged in the watch-strap portion 30, capacity of the rechargeable battery 40 can be effectively expanded, and the charging process of the rechargeable battery 40 can be effectively simplified, without affecting the size of the electronic wrist watch 100.

Figure 2:
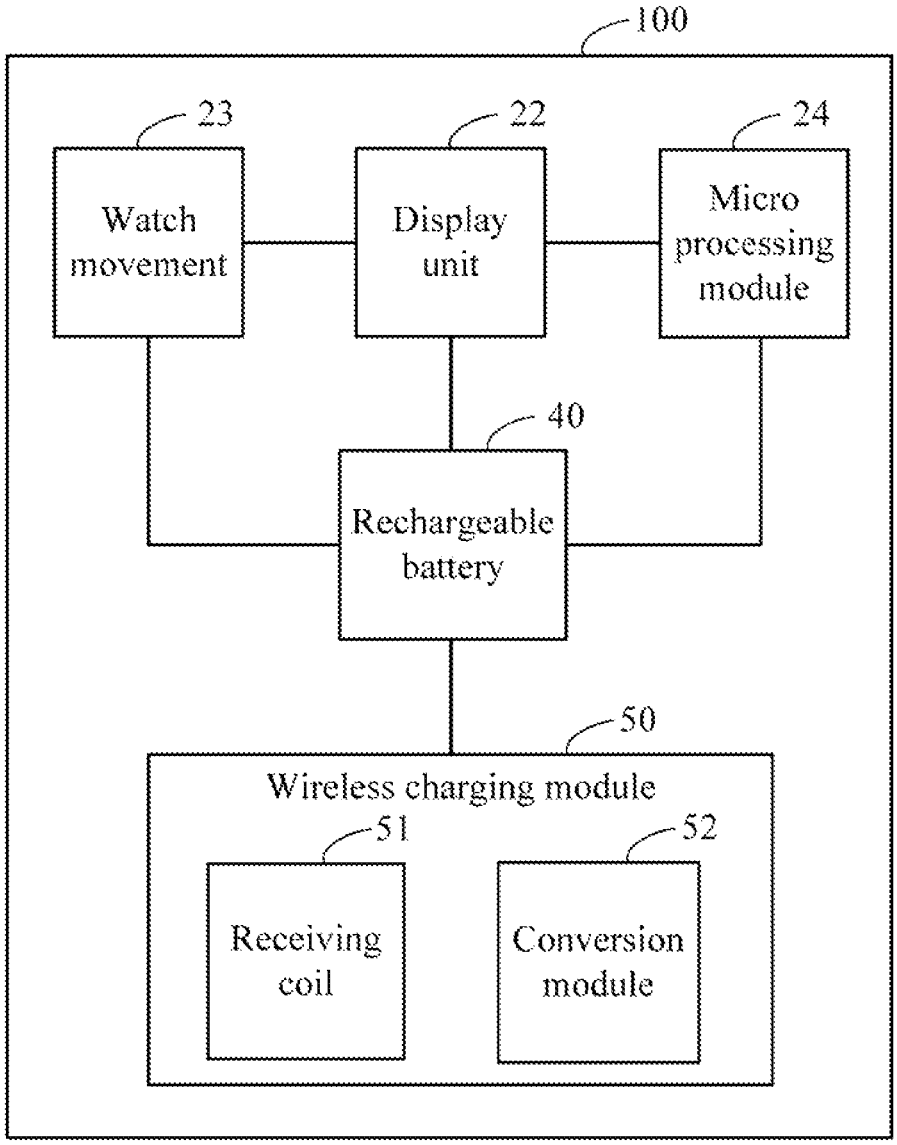
FIG. 2 is a block diagram of the electronic wrist watch of FIG. 1.

FIG. 2 shows that the electronic wrist watch 100 further includes a watch movement 23 and a micro processing module 24 arranged in the shell 21. The micro processing module 24 integrates with various auxiliary functions, such as audio playing function, NFC identification function, or GPS locating function, which can fully meet needs.

The display unit 22 is electrically connected to the watch movement 23, the micro processing module 24 and the rechargeable battery 40. The display unit 22 is configured to display time, residual capacity value of the rechargeable battery 40, and information of the auxiliary functions. In the illustrated embodiment, the display unit 22 is selected from a group consisting of a liquid crystal display, an organic light emitting diode display and an E-paper display.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. An electronic wrist watch comprising:

a body;

a watch-strap portion comprising a first watch strap and a second watch strap respectively connected to opposite end portions of the body, wherein the first watch strap and the second watch strap are configured to wear the electronic wrist watch on a wrist;

at least one chargeable battery configured to supply power to function modules of the electronic wrist watch; and a wireless charging module arranged in the watch-strap portion and electrically connected to the rechargeable battery, wherein the wireless charging module is configured to wirelessly collect external energy to charge the rechargeable battery.

2. The electronic wrist watch as described in claim 1, wherein the wireless charging module comprises a receiving coil configured to collect wireless electromagnetic energy emitted by a transmitting coil of an external power source.

3. The electronic wrist watch as described in claim 2, wherein the wireless charging module further comprises a conversion module configured to convert the collected wireless electromagnetic energy into to power having a predetermined voltage to charge the rechargeable battery.

4. The electronic wrist watch as described in claim 1, wherein the rechargeable battery is a flexible thin-film battery, and is arranged in the watch-strap portion.

5. The electronic wrist watch as described in claim 1, wherein the body comprises a shell, and a watch movement and a micro processing module arranged in the shell, wherein the micro processing module integrates with various auxiliary functions.

6. The electronic wrist watch as described in claim 5, wherein the body further comprises a display unit arranged on the shell, the display unit is electrically connected to the watch movement, the micro processing module and the rechargeable battery; wherein the display unit is configured to display time, residual capacity value of the battery, and information of the auxiliary functions.

7. The electronic wrist watch as described in claim 6, wherein the display unit is selected from a group consisting of a liquid crystal display, an organic light emitting diode display and an E-paper display.

8. The electronic wrist watch as described in claim 5, wherein the rechargeable battery is arranged in the shell of the body.

* * * * *